United States Patent [19]

Bettencourt et al.

[11] Patent Number: 4,552,426

[45] Date of Patent: Nov. 12, 1985

[54] MULTIPLE CONNECTOR HOOD FOR INTERCONNECTIONS TO PRINTED CIRCUIT BOARDS

[75] Inventors: George S. Bettencourt, Murrysville; Robert E. Strickler, Plum Boro, both of Pa.

[73] Assignee: Westinghouse Electric Corp., Pittsburgh, Pa.

[21] Appl. No.: 532,424

[22] Filed: Sep. 15, 1983

[51] Int. Cl.[4] ..... H01R 13/514

[52] U.S. Cl. ..... 339/75 M; 339/208

[58] Field of Search ..... 339/31 R, 107, 137, 339/141, 198 H, 196 M, 206 R, 206 P, 208, 75 P, 75 M, 63 R, 63 M, 210 M, 103 M

[56] References Cited

U.S. PATENT DOCUMENTS

| | | | |
|---|---|---|---|
| 2,850,712 | 9/1958 | Franklin | 339/103 M |
| 3,611,562 | 10/1971 | Herb | 29/626 |
| 3,692,966 | 9/1972 | Lancaster | 339/17 LM |
| 3,760,336 | 9/1973 | Cerwin | 339/137 |
| 3,986,764 | 10/1976 | Torburn | 339/75 M |
| 4,062,611 | 12/1977 | Carlsson et al. | 339/17 L |
| 4,133,592 | 1/1979 | Cobaugh et al. | 339/17 M |
| 4,330,935 | 5/1982 | Blair, Jr. et al. | 29/884 |
| 4,343,528 | 8/1982 | Lucius et al. | 339/206 R |
| 4,444,450 | 4/1984 | Huber | 339/107 |

FOREIGN PATENT DOCUMENTS

| | | | |
|---|---|---|---|
| 863366 | 1/1953 | Fed. Rep. of Germany | 339/75 P |
| 977312 | 11/1950 | France | 339/210 M |

*Primary Examiner*—Neil Abrams

*Attorney, Agent, or Firm*—Daniel C. Abeles

[57] ABSTRACT

A cable connection hood for housing a single or multiple socket connector, has a pair of mating wall sections that have abutting flanges and contain spacer blocks in various predetermined reconfigurable patterns. A wall section has a support flange spaced from an inwardly directed lip along the front thereon, with the spacer blocks fitting between the support flange and the lip. The spacer blocks comprise center portion blocks and end blocks and have means thereon for securement within the mated wall sections. The connector hood is usable with either round or flat cables and has means for preventing dislocation of socket connectors, contained therein, from card edge connectors during vibrations or shocks.

12 Claims, 28 Drawing Figures

MULTIPLE CONNECTOR HOOD FOR INTERCONNECTIONS TO PRINTED CIRCUIT BOARDS

BACKGROUND OF THE INVENTION

Field of the Invention

This invention is directed to a cable connector hood that houses either a single or multiple socket connector, for use with a printed circuit board, in various predetermined reconfigurable patterns, for connection to card edge connectors of printed circuit boards. The structure reduces connector mounting hardware requirements, allows a greater choice of socket connectors and wire types, provides packaging space for additional signal conditioning or processing components, improves connector retention in vibration prone environments, improves wiring appearance and provides for easy maintenance. The connector hoods are used with socket connectors for standardized interface printed circuit boards that are the building blocks of custom microprocessor systems.

Microprocessor based systems have become a basic building block for an ever increasing number of products. Generally, the microprocessors are mounted on printed circuit boards to manage data input and output. It is advantageous to use standardized components in connection with such microprocessors which can be adapted to meet a wide range of applications.

Such standard bus compatible printed circuit boards use card edge connectors at the input/output interface. The bus compatible printed circuit board to input/output interconnection systems that are available, while having some standardization, are not designed to be used in applications where vibrations or shocks may occur because the card edge connector is difficult to retain. Also, in some applications, these connectors (which are most commonly coupled to flat ribbon cable) and their associated wiring create excessive clutter at the front of the printed circuit boards' housing. This clutter detracts from system appearance and hinders maintenance or service operations.

It is an object of the present invention to provide a connector hood for use in printed circuit board to cable interconnection, which is vibration resistant, allows greater connector and cable choice, improved system intercommunication, simplifies maintenance, and reduces cable wire clutter.

SUMMARY OF THE INVENTION

A connector hood for use in connecting socket connectors to card edge connectors of a printed circuit board has a pair of mated wall sections with abutting flanges, an opening along the front portion thereof, and grooves for passage of at least one cable. A wall section has an inwardly directed lip, and an inwardly extending support flange spaced therefrom to receive and retain spacer blocks therebetween. Spacer blocks are provided which have engagement means that engage with engagement means on the inner surface of the wall sections. The spacer blocks may have projections which fit into indentations in the wall sections, and a recess and side flange or flanges which cooperate with the support flange on the wall section to retain socket connectors in predetermined positions within the connector hood. A series of such spacer blocks allows for a variety of predetermined configurations of the standard socket connectors in the hood.

The connector hood has securement means for securing the two wall sections together, and means are provided, such as channels in the rear portion which accept support means such as cross-bars that are secured across an enclosure to maintain the connection integrity during vibrations or shocks.

DESCRIPTION OF THE PREFERRED EMBODIMENTS

Figure 1:
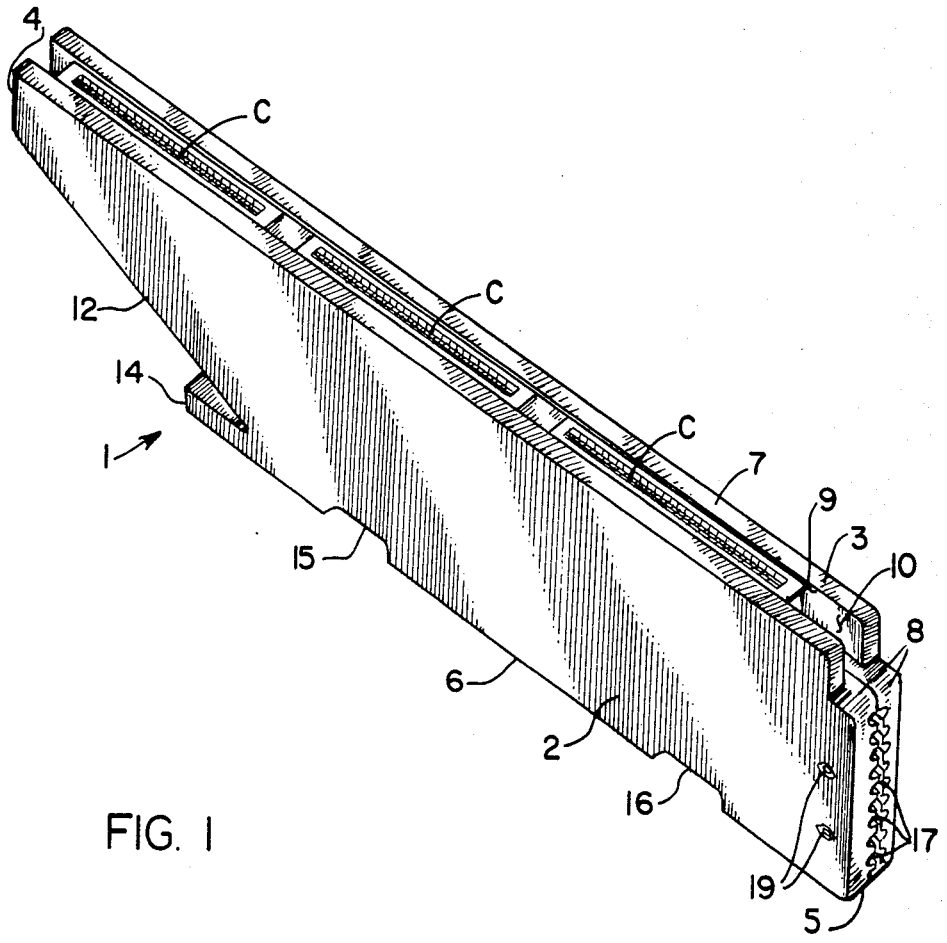
FIG. 1 is a perspective view of a connector hood of the present invention containing three socket connectors.
Figure 4:
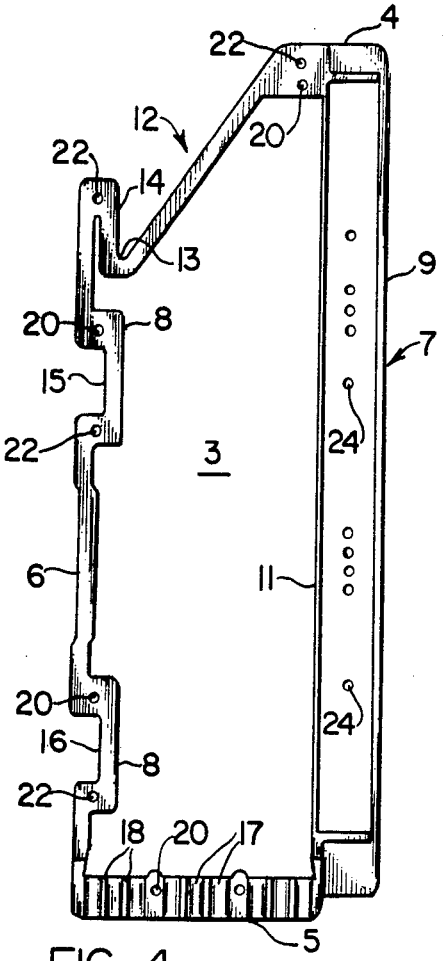
FIG. 4 is a plan view of the inner surface of the other wall section which mates with the wall section shown in FIG. 3, showing the support flange thereon.
Figure 3:
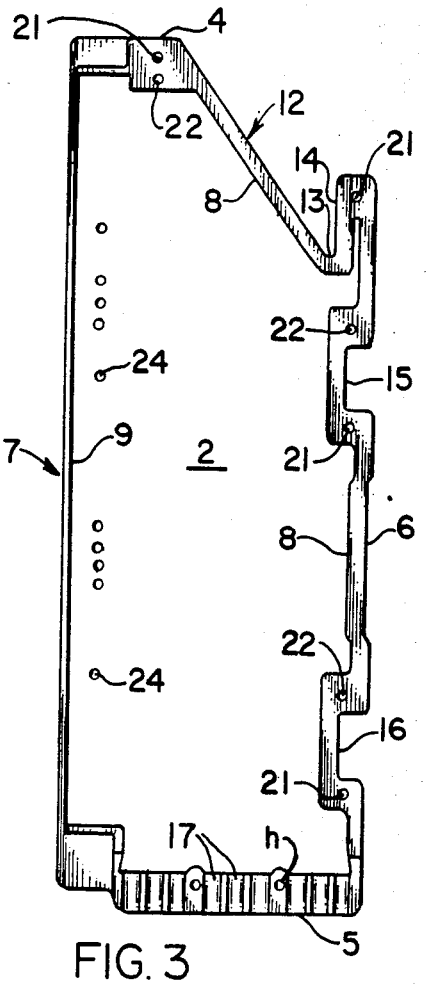
FIG. 3 is a plan view of the inner surface of one wall section of the connector hood of the present invention.
Figure 5:
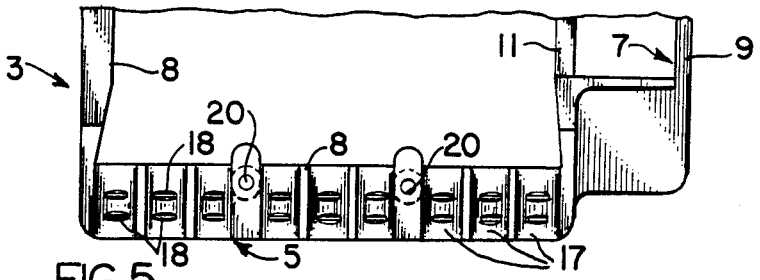
FIG. 5 is an enlarged plan view of the bottom portion of the wall section of FIG. 4.
Figure 6:
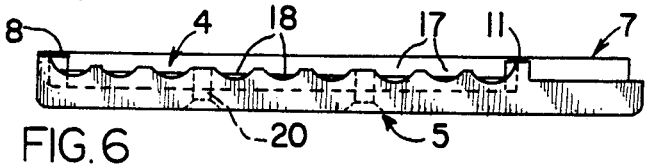
FIG. 6 is an end view of the bottom portion of wall section of FIG. 5.

Referring now to FIG. 1, the connector hood 1, of the present invention, includes a pair of mating wall sections 2 and 3, each wall section having a top portion 4, bottom portion 5, rear portion 6 and front portion 7. Inwardly extending flanges 8 are provided along the top, bottom and rear portions of each wall section and abut the flanges of the other wall section. Lips 9 extending inwardly along the front portion 7 of each wall section 2 and 3, terminate at a location spaced from each other to provide an opening 10 along the front of the mated wall sections. A vertically extending support flange 11, provided on one of the wall sections, such as 3 (FIG. 4), is inwardly directed and spaced from lip 9 along the front portion 7. The vertical support flange 11 preferably extends from the top portion 4 to the bottom portion 5 of the wall section 3.

The top portion 4 preferably extends rearwardly and downwardly from the front portion 7 at an angle, as indicated at 12, while the rear portion 6 projects beyond the rear terminus 13 of the top portion 4, so as to provide a projection 14 for grasping by a user. A pair of transverse channels 15 and 16 are formed in the rear portion 6 to provide for rigid support of the connectors in vibration-prone environments, as hereinafter described. In the flanges 8 of the bottom portion 5, there are preferably provided grooves 17 for the passage of a cable or cables from the interior of the connector hood to an exterior location. The connector hood is usable with either flat or round cables. The drawings illustrate a hood for use with round cables. As illustrated in FIGS. 3–6, there may be a plurality of grooves, such as nine grooves 17 provided, in each of the flanges of the bottom wall portion 5 of the wall sections 2 and 3 so as to enable passage of from one to nine round cables therethrough. The grooves 17 are semi-circular in cross-section with transverse ribs 18, which provide a gripping and locking means for the cables when the wall sections 2 and 3 are secured together. When flat cables are to be used, the semi-circular grooves are not needed, and a flat groove, or grooves, will suffice. This modification may be accomplished by machining the illustrated hood or by a mold modification.

Securement of the wall sections 2 and 3 together is effected by the use of securement means such as rivets, or screws inserted in countersunk holes 20 which engage the threaded inserts 19 that are fitted into holes h in the flanges 8 of the wall sections, or which form threads in the recesses 22. In addition, alignment pins 21 are provided on flanges 8 of the top and rear portions of one of the wall sections which mate with recesses 22 formed in the mating flange of the abutting wall section.

In order that socket connectors may be positioned at predetermined locations in the connector hood, a series of spacer blocks 23 are provided. Since socket connectors for use with card edge connectors are fairly standardized, the use of such spacer blocks, in addition to securing the connectors in position, permits various configurations of one or a plurality of such standard socket connectors to be arranged within a pair of the wall sections. In order to align and to secure the spacer blocks between a pair of mated wall sections 2 and 3, in the space between the top and bottom portions thereof, and adjacent the front lip 9, first engaging means, such as a series of indentations 24 are provided in the inner walls of the wall sections. The spacer blocks 23 have second engaging means, such as projections 25 thereon which fit within the indentations 24 of mated wall sections to secure spacer blocks and thus adjacent socket connectors between the mated wall sections. In addition to projections 25, the spacer blocks 23 may have a recessed section 26 and flanges 27 thereon which abut the support flange 11 of a wall section, to additionally secure the spacer blocks between mated wall sections.

Figure 7:
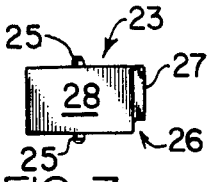
FIG. 7 is a side elevational view of a center spacer block for use in the connector hood.
Figure 9:
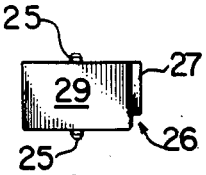
FIG. 9 is a side elevational view of another embodiment of a center spacer block for use in the connector hood.
Figure 11:
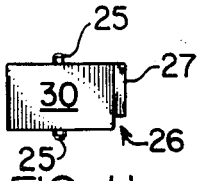
FIG. 11 is a side elevational view of an additional embodiment of a center spacer block for use in the connector hood.
Figure 8:
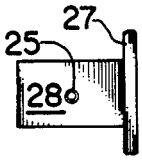
FIG. 8 is a plan view of the spacer block of FIG. 7.
Figure 10:
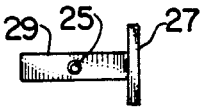
FIG. 10 is a plan view of the spacer block of FIG. 9.
Figure 12:
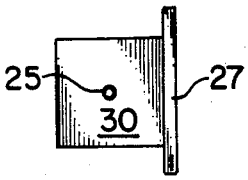
FIG. 12 is a plan view of the spacer block of FIG. 11.
Figure 13:
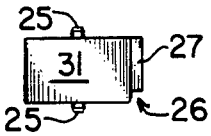
FIG. 13 is a side elevational view of a further center spacer block for use in the connector hood.
Figure 14:
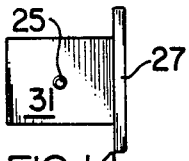
FIG. 14 is a plan view of the spacer block of FIG. 13.

As examples of the spacer blocks for use in the present invention, attention is drawn to FIGS. 7–22 which show various blocks in side elevational and plan view. A center portion spacer block 28 is illustrated in FIGS. 7 and 8, the block 28 having projections 25 and a pair of flanges 27 extending to both sides of the block above a recess 26. A similar center portion spacer block, but of a narrower dimension is illustrated in FIGS. 9 and 10, the block 29 also having projections 25, a recess 26 and a pair of side flanges 27. A third center portion spacer block 30 of a much wider dimension is illustrated in FIGS. 11 and 12, the block also having projections 25, recess 26 and a pair of flanges 27; and a fourth center portion spacer block 31 of an intermediate dimension is illustrated in FIGS. 13 and 14.

Figure 15:
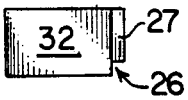
FIG. 15 is a side elevational view of an end spacer block for use in the connector hood.
Figure 17:
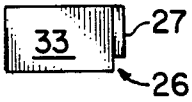
FIG. 17 is a side elevational view of another embodiment of an end spacer block for use in the connector hood.
Figure 16:
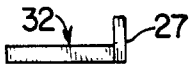
FIG. 16 is a plan view of the spacer block of FIG. 15.
Figure 18:
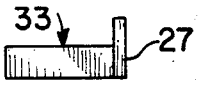
FIG. 18 is a plan view of the spacer block of FIG. 17.
Figure 19:
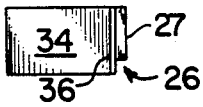
FIG. 19 is a side elevational view of an additional end spacer block for use in the connector hood.
Figure 21:
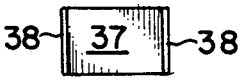
FIG. 21 is a side elevational view of a further end spacer block for use in the connector hood.
Figure 20:
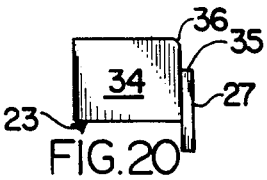
FIG. 20 is a plan view of the spacer block of FIG. 19.
Figure 22:
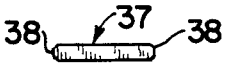
FIG. 22 is a plan view of the spacer block in FIG. 21.

An end portion spacer block 32 is illustrated in FIGS. 15 and 16, the block 32 being devoid of projections but having a recess 26 and single flange 27 extending therefrom on one side. FIGS. 17 and 18 illustrate a similar end portion spacer block of a larger width, the block 33 also having a recess 26 and single flange 27 extending from one side thereof, and block 33 being devoid of projections. In FIGS. 19 and 20, a further end portion spacer block 34 is shown, having a recess 26, and a flange 27 extending therefrom, but the flange 27 being spaced from the opposite side of the block, to provide a shoulder as at 35, on the end of the block 34, and the block having a bevelled edge 36 opposite the end having flange 27. Also, an end portion spacer block 37 is illustrated in FIGS. 21 and 22 which has no flanges but does have a pair of bevelled edges 38 on both ends thereof.

Figure 23:
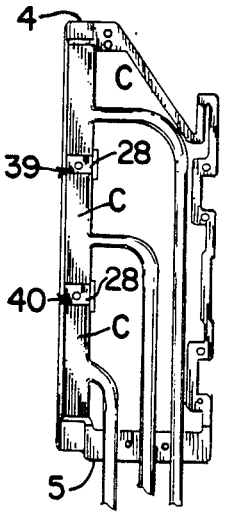
FIG. 23 is a schematic view of placement of spacer blocks in a wall section to give one configuration of socket connector positioning in the connector hood.

By using the spacer blocks 23 in conjunction with the two mating wall sections 2 and 3, various predetermined configurations of the placement of one or more socket connectors in the connector hood 1 is readily achieved. For example, the placement of three socket connectors c within a connector hood can be effected by the use of two center portion spacer blocks 28, as illustrated in FIG. 23. After placement of the spacer blocks 28 into position, with a projection 25 fitting in an indentation 24 in the inner wall of a wall section, the support flange 11 of the wall section will fit within the recess 26 with the side flanges of the block resting on the support flange 11. One socket connector thus is positionable between top portion 4 of the wall section and upper center spacer block 39, a second socket connector is positionable between the upper center spacer block 39 and a lower center spacer block 40, and a third socket connector is positionable between the lower center spacer block 40 and the bottom portion 5 of the wall section.

Figure 24:
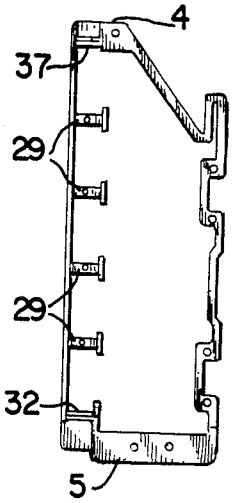
FIG. 24 is a schematic view of another placement of spacer blocks in a wall section to give another configuration of socket connector positioning.
Figure 25:
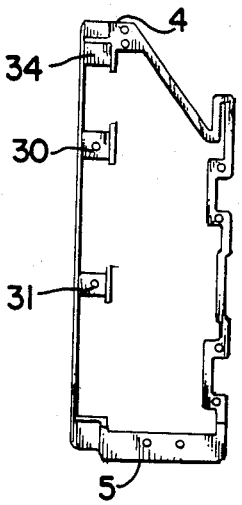
FIG. 25 is a further schematic view of a further placement of spacer blocks.

An example of the placement of five smaller sized socket connectors within a connector hood is achieved by the configuration illustrated in FIG. 24, wherein four narrower sized spacer blocks 29 are positioned between the top portion 4 and bottom portion 5 of a wall section, while a bevelled ended spacing block 37 is placed adjacent the top portion 4 and an end spacer block 32 is placed adjacent the bottom portion 5. Placement of the two larger size socket connectors and one smaller size socket connector is achieved by the configuration illustrated in FIG. 25, where an end spacer block 34 is positioned adjacent the top portion 4 of a wall section, a larger size center portion spacer block 30 is positioned a distance from block 34, and an intermediate size center portion spacer block 31 is positioned between block 34 and bottom portion 5 of the wall section. Such a configuration enables securement of a small socket connector between blocks 34 and 30, a large socket connector between blocks 30 and 31, a large socket connector between block 31 and bottom portion 5.

Figure 26:
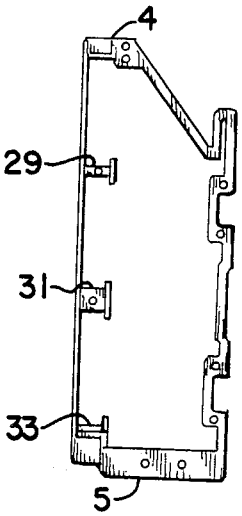
FIG. 26 is a yet further schematic view of a yet further placement of spacer blocks.

A realignment of the positioning of socket connectors is also achievable using various spacing blocks. As an example, the positioning of three larger socket connectors within a connector hood, as in FIG. 23, is possible where the bottom two socket connectors are positioned slightly closer to the top socket connector. As illustrated in FIG. 26, such a realignment is shown, where an end spacer block 33 is positioned adjacent bottom portion 5, an intermediate center spacer block 31 is spaced therefrom, and a narrow spacer block 29 is positioned between block 31 and top portion 4 of the wall section.

Figure 27:
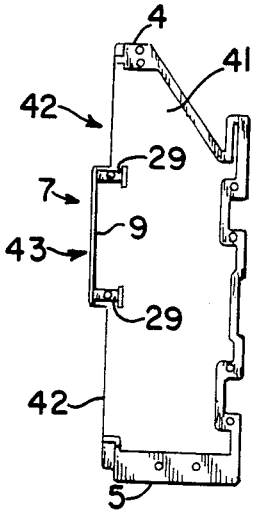
FIG. 27 is a schematic view of a wall section with sections thereof removed to adapt the connector for use where obstructions exist above and below a card edge connector of a circuit board.

In a further embodiment of the invention, as illustrated in FIG. 27, a section, or sections, of the front portion 7 of the wall sections may be removed so as to enable the connector hood 41 to be used in situations where obstructions might prevent a close fit of a socket connector, retained in the hood, with a card edge connector. As illustrated, a section or sections 42 of the front portion of the wall sections 2 and 3 are removed such that the central section 42 is in the nature of a projection. With two center spacer blocks 29 positioned adjacent the ends of the central section, a socket connector is securable therebetween and is connectable with a card edge connector where obstructions may be present either above or below the card edge connector which could prevent positioning of a previously disclosed socket connector for connection therewith.

Figure 2:
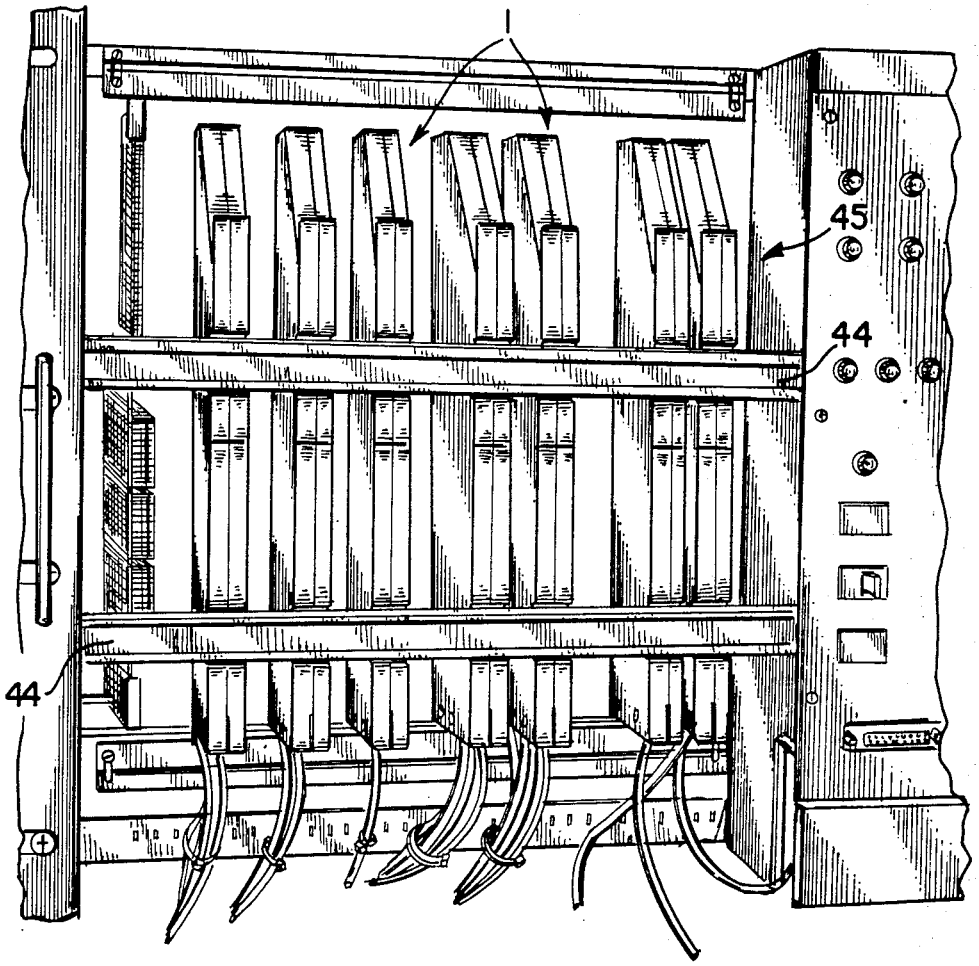
FIG. 2 is a perspective view of a plurality of the connector hoods positioned within an enclosure and with socket connectors connected to printed circuit boards, with bars fitting in channels in the connector hoods to maintain connection integrity during vibration.

As presently described, the connector hoods are especially adaptable for use in equipment which may be subject to shock or vibration-prone environments. To this end, the upper and lower channels 15 and 16 are provided in the wall sections 2 and 3 and, upon positioning of the connector hoods in a system, with the socket connectors therein conductively connected to card edge connectors of the system, as illustrated in FIG. 2, support means, such as bars 44 are secured across an enclosure 45 containing the system, with the bars 44 fitting within channels 15 and 16. With such a securement, the socket connectors contained within the connector hoods 1, will be tightly mounted and resistant to separation from card edge connectors during exposure to vibrations and shocks.

An advantage of the present connector hood is that the hood provides a mounting system that configures single of multiple socket connectors into specific predetermined standardized patterns for use with standard printed circuit cards. The hood is adaptable to either round or flat multiconductor cable.

Figure 28:
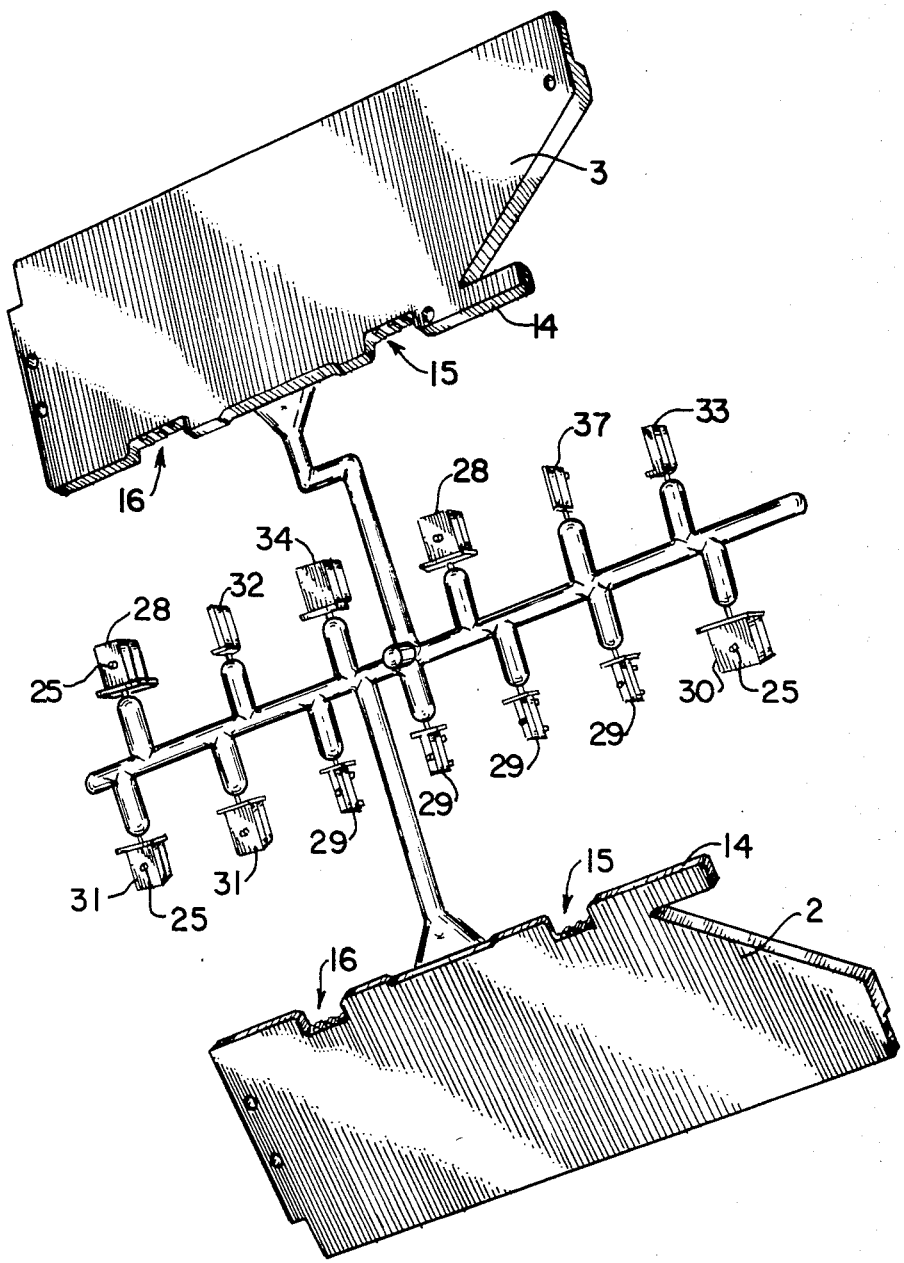
FIG. 28 is a perspective view of a molded form containing two wall sections and a series of connector blocks from a single molding step.

In addition, in view of the use of a series of specially designed, but standardized, spacer blocks, the components of the hood, i.e. the two wall sections 2 and 3 and a series of blocks 23 can be formed simultaneously in a single mold. As illustrated in FIG. 28, an injection molded form may be produced which includes the two wall sections 2 and 3 and a series of spacer blocks, center portion spacer blocks 28, 29, 30 and 31, as well as end portion spacer blocks 32, 33, 34 and 37. Thus, upon molding of a series of such forms, a supply of the standardized spacer blocks are formed along with the wall sections. The user need only choose the blocks necessary, to formulate the configuration desired, and can construct a connector hood for use with a particular socket connector or plurality of connectors.

The connector hood is formed from a dielectric material, preferably a moldable material, such as a 40 percent glass filled polycarbonate material, and indicia may be molded into the inner walls of the wall sections adjacent indentations therein to provide a code that will readily enable the user to position desired blocks to form a particular pattern for retention of socket connectors within the board.

We claim:

1. A connector hood for use in connecting at least one socket connector to at least one card edge connector of a printed circuit board, comprising:

(a) a pair of mating wall sections formed from a dielectric material, each wall section having top, bottom, rear and front portions, the top, bottom and rear portions having inwardly extending, mating flanges thereon and the front portion having an inwardly directed lip, the flanges releasably secured together to provide an opening along the front of the mated wall sections between confronting lips thereof, at least one of the wall sections having a vertically extending, inwardly directed support flange spaced from the lips thereof;

(b) first engaging means adjacent the front portion of the wall sections for engaging spacer blocks therebetween, said first engaging means being indentations in the inner surface of the wall section;

(c) a plurality of spacer blocks, formed from a dielectric material, having (1) second engaging means thereon for engagement with the first engaging means of the wall section, said second engaging means being projections fitting within said indentations in the inner surface of the wall section when the spacer blocks are secured within the wall section, (2) a recess therein and (3) at least one side flange, the side flange of the spacer block resting on said support flange, with the support flange positioned within said recess, said spacer blocks, adapted to fit between said inwardly directed lip and said support flange and with said lips secure at least one socket connector therebetween, completely within the mated wall sections, adjacent said opening; and (d) at least one groove in the flanges of a wall section for passage of a cable to be electrically connected to a socket connector secured by said space blocks.

2. A connector hood as defined in claim 1 wherein said spacer blocks have to side flanges, one extending from each side of said spacer blocks.

3. A connector hood as defined in claim 1 wherein additionally at least one spacer block is provided having bevelled edges and serves as an end spacer block, the bevelled edge fitting within a shoulder on one of the flanges on the wall sections.

4. A connector hood as defined in claim 1 wherein the groove in the flanges of a wall is adapted to receive at least one flat cable for connection to at least one socket connector secured by the spacer blocks.

5. A connector hood as defined in claim 1 wherein the groove in the flanges of a wall section is adaptable to receive a round cable for connection to a socket connector secured by the spacer blocks.

6. A connector hood as defined in claim 5 wherein a plurality of said grooves is provided, adapted to receive a plurality of round cables for connection to a plurality of socket connectors secured by the spacer blocks.

7. A connector hood as defined in claim 1 wherein the flanges of said top and rear portions of the wall sections have recesses therein and alignment pins thereon which mate with each other when the flanges of the wall sections are in abutting relationship.

8. A connector hood as defined in claim 1 wherein securement means are provided on the flanges of the wall sections to releasably secure the wall sections together in abutting relationship.

9. A connector hood as defined in claim 8 wherein said securement means comprises holes through flanges of the wall sections containing threaded inserts, and screws secured within the threaded inserts to secure the wall sections in abutting relationship.

10. A connector hood as defined in claim 1 wherein the rear portion of the wall sections have channels formed therein for receipt of support means to tightly mount the connector hoods within an enclosure.

11. A connector hood as defined in claim 10 wherein the hood is secured within an enclosure, with socket connectors therein connected to card edge connectors of printed circuit boards, by means of bars extending across the enclosure and fitting within said channels.

12. A connector hood as defined in claim 1 wherein at least one section of the front portion of the wall sections is removed to enable the connector hood to be used where obstructions are present adjacent a card edge connector.

* * * * *